United States Patent [19]

Walker et al.

[11] 4,198,020

[45] Apr. 15, 1980

[54] CONTAINER SUPPORT

[75] Inventors: George A. Walker; Leavenworth P. Sperry, both of Middlebury; Robert B. Sutherland, Wilton, all of Conn.

[73] Assignee: Waterbury Companies, Inc., Waterbury, Conn.

[21] Appl. No.: 933,527

[22] Filed: Aug. 14, 1978

[51] Int. Cl.[2] ..... A47G 23/02

[52] U.S. Cl. ..... 248/154; 47/84; 248/499

[58] Field of Search ..... 248/150, 154, 346, 499; 211/85; 47/84

[56] References Cited

U.S. PATENT DOCUMENTS

| | | | |
|---|---|---|---|
| 630,734 | 8/1899 | Oothout | 248/154 |
| 2,315,196 | 3/1943 | Gallione | 248/499 |
| 2,665,872 | 1/1954 | DeWitt | 248/346 X |
| 2,959,387 | 11/1960 | Ficek | 248/154 X |
| 3,211,404 | 10/1965 | Edmiston | 248/154 |
| 3,249,329 | 5/1966 | Currier | 248/154 X |
| 3,297,289 | 1/1967 | Raus | 248/346 X |
| 3,353,773 | 11/1967 | Budd | 248/529 X |
| 3,480,241 | 11/1969 | Moyer | 248/499 X |
| 3,488,022 | 1/1970 | Vittori | 248/346 X |
| 3,790,115 | 2/1974 | Fox | 248/346 X |

FOREIGN PATENT DOCUMENTS

| | | | |
|---|---|---|---|
| 182840 | 8/1955 | Austria | 248/154 |

*Primary Examiner*—J. Franklin Foss
*Attorney, Agent, or Firm*—E. Seward Stevens

[57] ABSTRACT

Our invention relates to improved devices for supporting in upright position, containers for plants, flowers, liquids, etc. during transportation of same, or when located in exposed situations, comprising a "knock-down" base, resilient elements releasably and adjustably secured thereto and carrying receptacle engaging elements.

7 Claims, 7 Drawing Figures

30
2
5
38
1
6
38

11
26
2
7
15
16
17

CONTAINER SUPPORT

OBJECTS

The object of our invention is to provide a receptacle retaining device capable of quick assembly and disassembly to releasably support containers of varying size or shape.

Another object is to provide a device of the character indicated comprising a base of cross-members adapted to receive therein the ends of resilient members that are adjustable and which resilient members carry receptacle engaging elements at their other ends.

A further object is to provide a device of the type described in which the base members are provided with anti-skid elements on their bottom surfaces and the top of the assembled members form a base in a horizontal plane to support a receptacle base thereon.

PRIOR ART

Applicants have considered forty nine prior patents relating to this art but consider the following the only ones of interest with respect to their invention; viz-Edmiston et al U.S. Pat. Nos. 3,211,404; Osley 1,228,813; Brayton 3,532,313 and Wider (BR) 19,360 (1899). The other patents referred to are listed in the patentability statement filed with this application.

Concerning the patents of interest noted above the novel elements of applicants' structure appear to be the "knockdown" base, the construction of its members with the means for securing the resilient elements, the adjustability of the members, the anti skid pads on the base elements and the simplicity of the assembly and construction of the device.

Practical embodiments of our invention are illustrated in the accompanying drawings in which FIG. 1 illustrates in plan perspective, the base and resilient members mounted therein, FIG. 2 illustrates the assembled invention as applied to a pot or other receptacle, with the base members rotated 180° from FIG. 1, and the receptacle shown in dotted outline.

Figure 1:
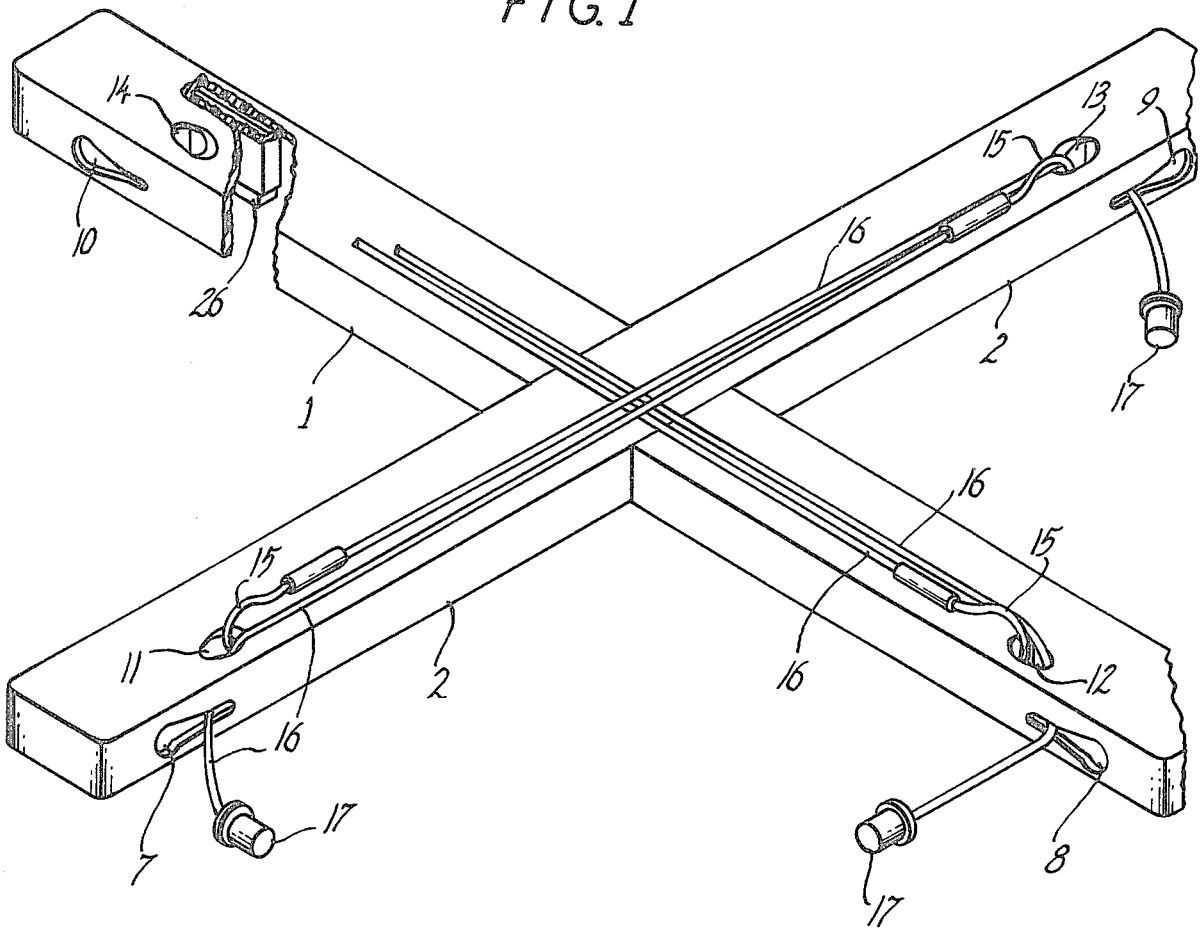
Figures 3, 4:
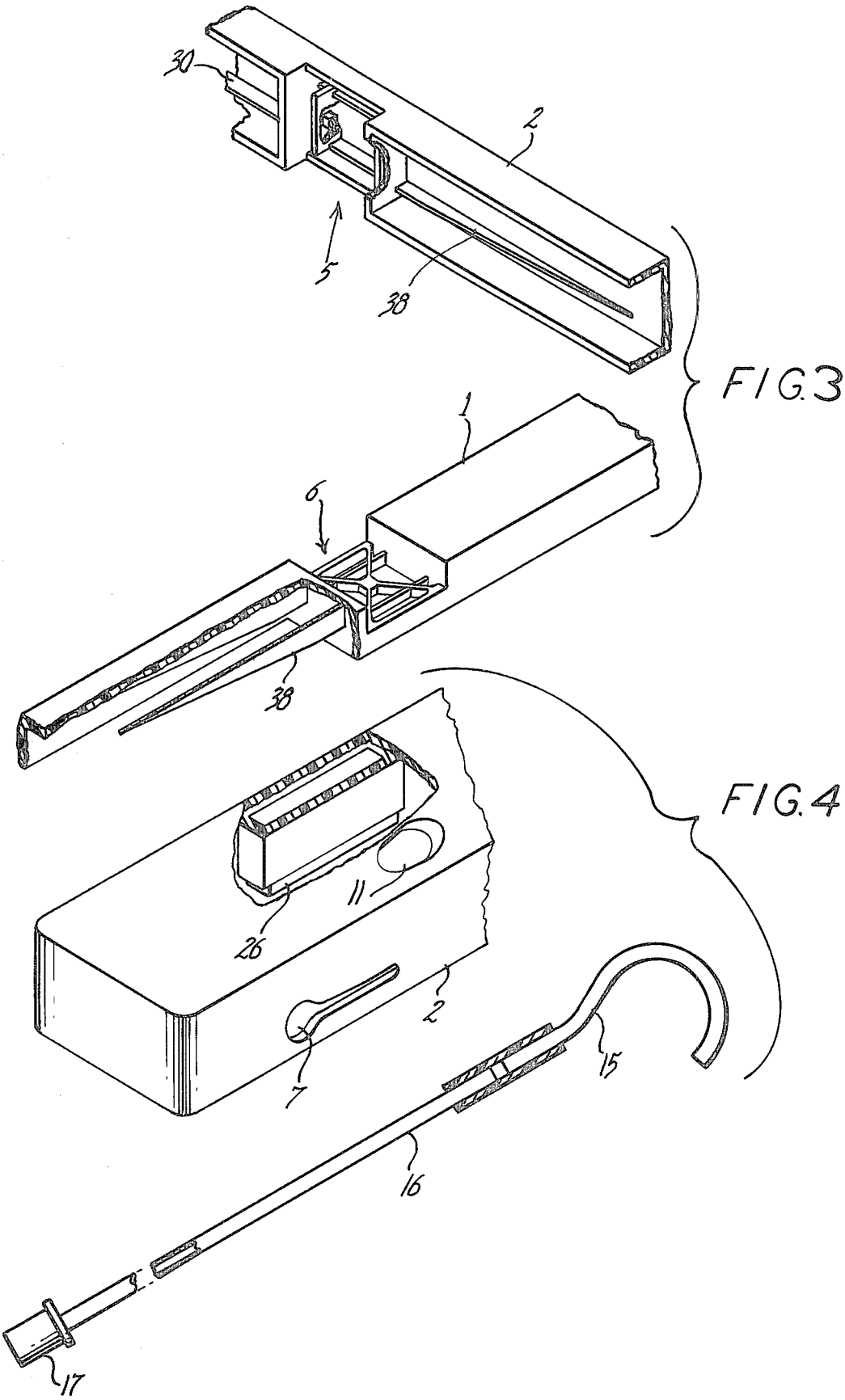
FIG. 3 shows, in perspective, the base members, partly broken away, to illustrate the construction thereof which permits the quick and secure assembly of same.
FIG. 4 shows on an enlarged scale from FIG. 1, a segment of a base member, partly in section, including a hole and tear-shaped slot for accomodating an assembled resilient member, shown therewith, also partly in section.
Figure 5:
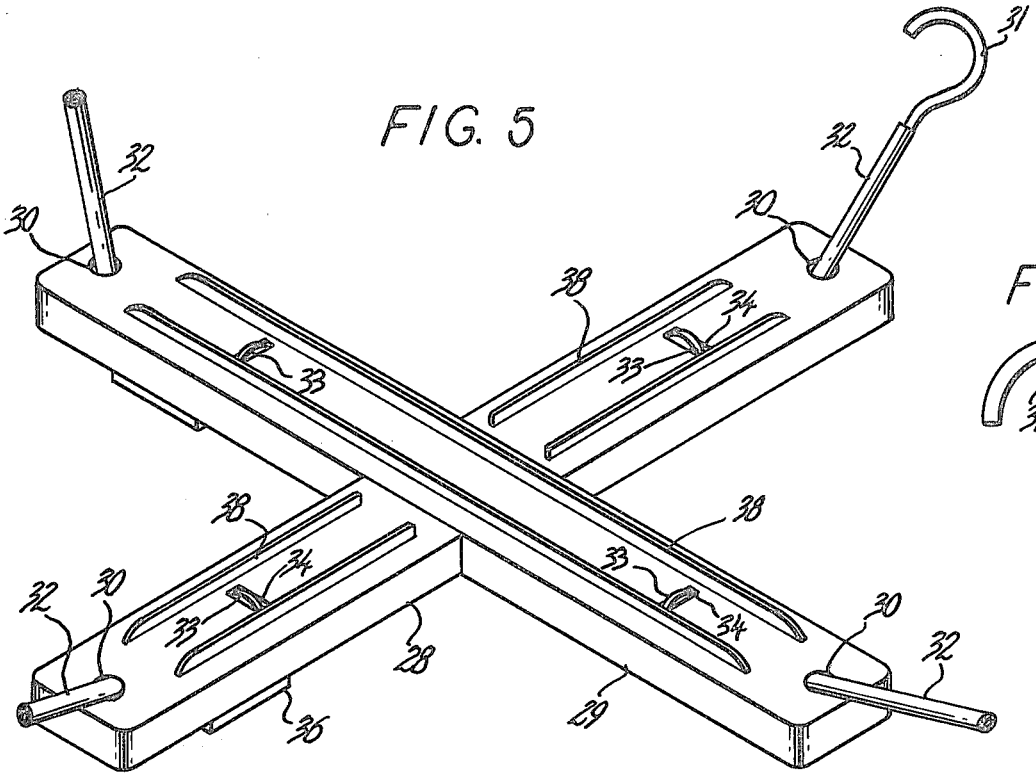
FIG. 5 represents in perspective, a plan view of a modified form of base.
Figure 6:
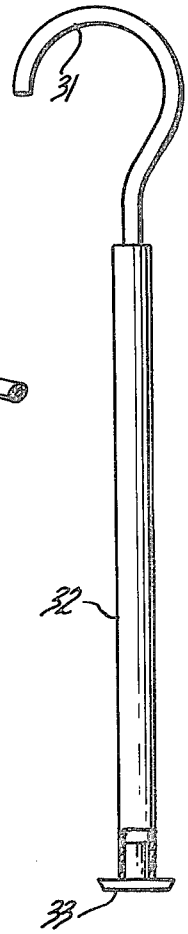
FIG. 6 shows one of the resilient elements of FIG. 5, partly broken away, to show a base-engaging member that serves to anchor the resilient element to the base.
Figure 7:
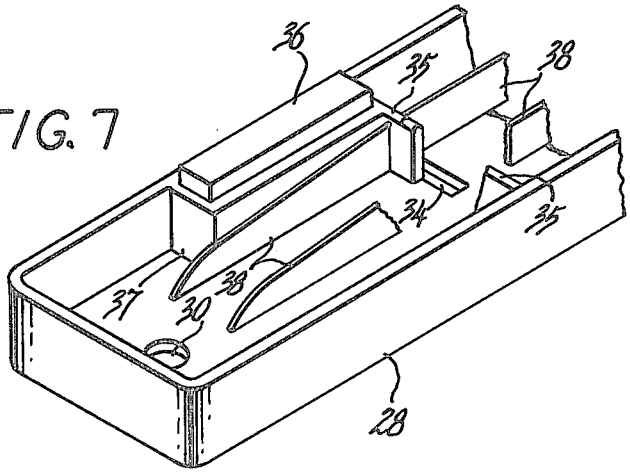
FIG. 7 shows on an enlarged scale from FIG. 5 a segment of the base member thereof as viewed from the underside and illustrating one of the rubberized-cork feet fitted therein.

Referring to the accompanying drawings in which the same numerals refer to the same parts in each view, two plastic bars are denoted by 1 and 2, the undersides of which bars are cored out as indicated in FIGS. 1 and 3. As illustrated in FIG. 3, depressions at the midsections of bars 1 and 2 are molded in to said bars and are indicated by the numerals 5 and 6. Such arrangement allows for snapping the two bars 1,2 firmly together to form a cross with all four "legs" being of equal length. When assembled as a cross, the hollowed or cored out side is used as the down or underside.

We provide a "vee" cutout in each leg denoted by the numerals 7, 8, 9 and 10. Adjacent each "vee" cutout we also provide a hole 11, 12, 13 and 14. Through each cutout 7, 8, 9 and 10 and then through each hole 11, 12, 13 and 14 is threaded a steel "question mark" shaped hook 15. Each hook is affixed, as by gluing with a special adhesive, into a hollow, elastic, surgical-type tubing 16. A plastic terminal button 17 is likewise affixed into the end opposite hook 15 of the tubing to prevent that end from passing through cutouts 7–10 provided in the legs.

To secure receptacle 23, such as a floral container, same is placed on the center of the cross which is lying flat. Hooks 15 have been detached from their FIG. 1 position, with their free, hooked ends placed clear of the receptacle mounting area. The opposite ends of the elastic tubes 16 may retain the cinched position indicated in FIG. 1. With the receptacle in place, hooks 15 are anchored onto the top rim 24 of the receptacle or container 23, as shown in FIG. 2.

More specifically, two oppositely located hooks 15 are first placed in firm engagement with rim 24 and the two opposite ends of the tubing may be grasped and released from their cinched positions and pulled simultaneously in opposite directions to create the desired tension with respect to the receptacle and base. Then without releasing tension, the terminal ends are simultaneously jerked in the opposite direction toward the center of the base. Accordingly, the tubing 16 is drawn far into the narrow portions of the "vee" cuts and thereby firmly anchored. The remaining two hooks are anchored to the rim 24 of the receptacle or container in the same manner and tensioned anchoring likewise effected. Thus by anchoring from four equidistant directions, due to the orientation of the legs 1 and 2 of the base, the receptacle or container is held firmly, but yieldingly, to the base.

Figure 2:
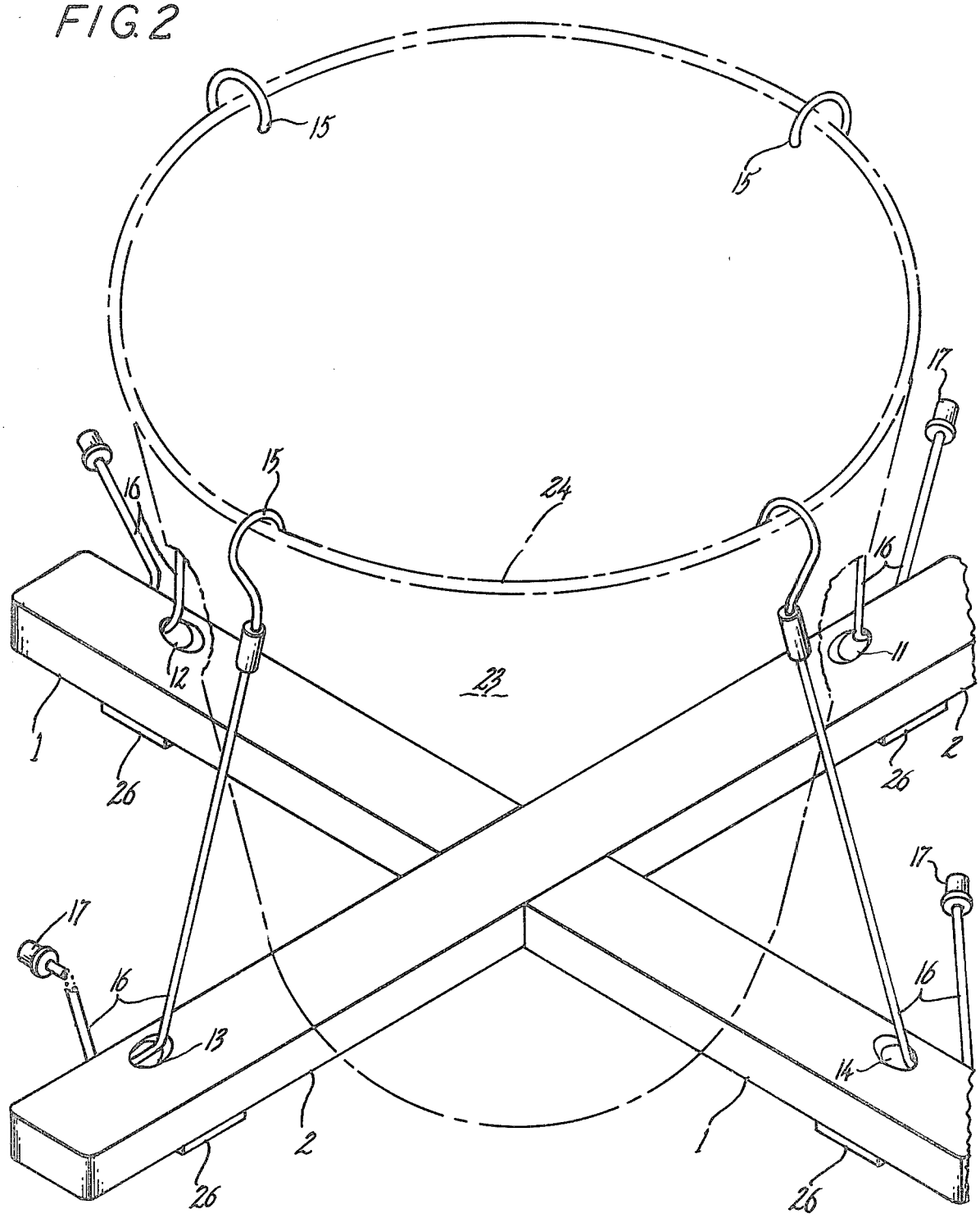

To prevent the base and receptacle secured thereon from sliding or other undesirable movement during transportation, or under other conditions where stabilization is desired, we provide legs 1 and 2 of the base with rubberized cork pads or feet 26, two for each leg, which extend downwardly from the underside of the legs, as illustrated in FIG. 2.

Means are provided for shortening the tubes 16. Accordingly, each terminal number 17 is grasped and the tubing 16 is drawn out of the narrow "vee" cut, into and through the wider opening in the "vee" cutout until the desired tautness is achieved. Then the free end of the tubing is again drawn fully into the narrow portion of the "vee" and cinched or secured therein. The operation is repeated for the other three tubing assemblies. With such arrangement it can be readily appreciated that each length of tubing can be shortened (or lengthened) by merely releasing, tensioning and again securing the tubing 16 with more tubing left over.

On the other hand, larger receptacles than disclosed in FIG. 1 can be accommodated, even to the extent of allowing full use of the tubing 16 as far as terminal 17 permits, terminal 17 cannot pass through the "vee" cut.

In a modification of our invention disclosed in FIGS. 5–8, bars or legs 28 and 29 are provided with a hole 30 located near the end portions of each bar. Through each hole 30 is threaded or inserted a steel "question-mark" shaped hook 31 (see FIG. 6). The hook is fixed, as by gluing with a special adhesive, into a hollow, elastic, surgical-type tubing 32. The tubing is shorter and stouter than the tubing 16 shown in FIGS. 1, 2 and 4.

A small, button-like, mushroom-shaped plastic terminal 33 is also glued or affixed by special adhesive, stem first, into the end opposite hook 31 of the tubing 32 to prevent said end from passing through hole 30 in each bar.

To secure a receptacle, same is placed on the center of the cross which is lying flat. The hooks may be laid back, each rearward of its associated bar 28–29. The hook 31 may then be engaged with the rim of the receptacle by stretching each elastic tube 32, as set out earlier in the specification. The end portions of terminals 33 are captured at the underside of the legs 28 and 29, said end portions being of greater diameter than holes 30.

As pointed out in connection with FIGS. 1–4, by hooking the receptacle from four equidistant directions, 90° apart, the receptacle is held firmly yet yieldably to the base. Such mounting serves to prevent the receptacle from damage due to sudden and unexpected movement or shock.

Moreover, the tubing 32 may be shortened to increase tautness or adjusted for shallow, low profile receptacles. With hooks 31 in place on the rim of the receptacle each terminal 33 may be drawm toward the center of the cross to tense tubing 32. Each terminal 33 is then secured in an oblong-shaped opening 34, two of which are formed in each leg 29 and 30 (see FIG. 5) and the tubing 32 force fitted between a pair of ribs 35 formed at the underside of each leg adjacent openings 34. Ribs 35, one of which is broken away, may be seen in FIG. 7.

Also, to prevent the base and receptacle thereon from sliding or other undesirable movement during transportation of the assembly in a truck or van, four rubberized cork feet or pads 36 which extend downwardly from the underside of bars 28 and 29 are provided. Pads 36 may be identical to pads 26 shown in FIGS. 1, 2 and 4 and therefore may be used with either embodiment disclosed. As in the referred to Figs. pads 36 are held in place by being compressed into tight fitting restraining wells 37, see FIG. 7. Two pads 36 are provided for each bar 28–29, the second pad (not shown) located in a like manner at the opposite ends and across from the pads 36 viewed in FIG. 5.

Reinforcing ribs are provided both atop and in the hollowed out portions of the bars 28–29 to minimize bowing and give rigidity to the base structure.

Since it is evident that changes may be made in the form, construction and arrangement of the several parts of the apparatus disclosed without departing from the spirit and scope of the invention, we do not intend to be limited to the specific embodiment shown and described except as set forth in the appended claims.

We claim:

1. A retaining device for a receptacle comprising, a plurality of demountable members forming a receptacle support, each of said demountable members having a top surface and a plurality of side walls, a set of adjacent openings formed in each of said members, a plurality of tensioning means, and a receptacle engaging element attached to each of said tensioning means, each of said tensioning means located in each of said openings and each adjustably secured in said receptacle engaging elements adapted for receptacle retaining on said receptacle support.

2. A structure according to claim 1 in which a first opening of said set is formed in said top surface and a second opening of said set is formed in said side walls of said demountable members.

3. A structure according to claim 1 in which each of said tensioning means is elastic and provided with an anchor at its outer extremity.

4. A structure according to claim 1 in which each demountable member is provided with an interior and said interior is provided with at least one slotted cross rib extending across said interior of each of said cross members.

5. A structure according to claim 2 in which the tensioning means are threaded through said adjacent openings, the openings in said side walls being adapted to jam the tensioning device when same are pulled toward the center of the device.

6. A structure according to claim 4 in which the tensioning means are adjustable by inserting the terminal retaining means in said slotted cross rib.

7. A structure according to claim 6 in which said demountable member is provided with a cutout section associated with said slotted cross ribs and the means for adjusting the length of the tensioning means includes both said slotted cross rib and said cutout section in said demountable member adopted to receive the terminal of said tentioning means.

* * * * *